US009289781B2

(12) United States Patent
Yager

(10) Patent No.: US 9,289,781 B2
(45) Date of Patent: Mar. 22, 2016

(54) RADIATION ASSISTED ELECTROSTATIC SEPARATION OF SEMICONDUCTOR MATERIALS

(75) Inventor: Thomas A. Yager, Encinitas, CA (US)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 632 days.

(21) Appl. No.: 13/144,869

(22) PCT Filed: Mar. 18, 2011

(86) PCT No.: PCT/US2011/029064

§ 371 (c)(1),
(2), (4) Date: Jul. 15, 2011

(87) PCT Pub. No.: WO2012/128745

PCT Pub. Date: Sep. 27, 2012

(65) Prior Publication Data

US 2012/0234730 A1 Sep. 20, 2012

(51) Int. Cl.

| | |
|---|---|
| ***B03B 1/00*** | (2006.01) |
| ***B03C 7/00*** | (2006.01) |
| ***B03C 3/016*** | (2006.01) |
| ***B03C 7/04*** | (2006.01) |
| ***B03C 7/08*** | (2006.01) |

(52) U.S. Cl.

CPC ..... *B03C 7/003* (2013.01); *B03C 3/016* (2013.01); *B03C 7/04* (2013.01); *B03C 7/08* (2013.01)

(58) Field of Classification Search

CPC ..... B03C 7/003; B03C 7/04; B03C 7/08; B03C 3/016; B03C 1/00; B07C 5/34; B07C 5/3416; B07C 5/3427; B07C 5/344

USPC ..... 209/3, 12.2, 128, 4, 577

See application file for complete search history.

(56) References Cited

U.S. PATENT DOCUMENTS

| | | | |
|---|---|---|---|
| 3,448,857 | A | 6/1969 | Benson et al. |
| 3,970,546 | A | 7/1976 | Webb et al. |

(Continued)

FOREIGN PATENT DOCUMENTS

| | | | |
|---|---|---|---|
| CN | 1654129 | A | 8/2005 |
| CN | 201058305 | Y | 5/2008 |

OTHER PUBLICATIONS

Betts, Kellyn, "Producing Usable Materials from e-waste", ewasteguide.info, submitted by mathias on Wed. Jul. 30, 2008 16:14, http://ewasteguide.info/producing-usable-mat.

(Continued)

*Primary Examiner* — Joseph C Rodriguez
*Assistant Examiner* — Kalyanavenkateshware Kumar
(74) *Attorney, Agent, or Firm* — Foley & Lardner LLP

(57) ABSTRACT

A method of separating material includes providing a mixture of a first material, such as a semiconductor, and a second material, such as an insulator or a different semiconductor. The mixture can be irradiated using a light source at a wavelength that causes the first material's conductivity to increase while leaving the second material's conductivity (substantially) unchanged. Placing the mixture in contact with a ground electrode discharges the first material but not the second material due to the difference in their conductivities. Applying an electric field to the discharged mixture separates the discharged first material from the second material.

11 Claims, 2 Drawing Sheets

(56) References Cited

U.S. PATENT DOCUMENTS

| | | | | |
|---|---|---|---|---|
| 5,161,695 | A | 11/1992 | Roos | |
| 5,683,040 | A | 11/1997 | Jakob et al. | |
| 2002/0014441 | A1 * | 2/2002 | Yoshida et al. | 209/127.1 |

OTHER PUBLICATIONS

International Search Report and Written Opinion for PCT/US2011/029064 dated May 9, 2011.

Jia Li, Hongzhou Lu, Jie Guo, Zhenming Xu, and Yaohe Zhou "Recycle Technology for Recovering Resources and Products from Waste Printed Circuit Boards" Environ. Sci. Technol., 2007, 41 (6), pp. 1995-2000.

Yung-Fu Wu, and Yuan-Ming Chen "Separation of silicon and silicon carbide using an electrical field" Separation and Purification Technology vol. 68, Issue 1, Jun. 30, 2009, pp. 70-74.

Dascalescu, W. et al., "CORONA-Electrostatic Separation: An Efficient Technique for the Recovery of Metals and Plastics From Industrial Wastes," Magnetic and Electrical Separation, vol. 4, No. 4, pp. 241-255 (1993).

Gloeckler, M. and Sites, J. R., "Band-gap grading in Cu(In,Ga)Se2 solar cells," Journal of Physics and Chemistry of Solids, vol. 66, No. 11, Nov. 2005, pp. 1891-1894.

International Preliminary Report on Patentability for PCT Appl. Ser. No. PCT/US2011/029064 dated Oct. 3, 2013.

Tilmatine, A. et al., "Electrostatic separators of particles: Application to plastic/metal, metal/metal and plastic/plastic Mixtures," Waste Management, vol. 29, No. 1, pp. 228-232 (2009).

* cited by examiner

RADIATION ASSISTED ELECTROSTATIC SEPARATION OF SEMICONDUCTOR MATERIALS

CROSS-REFERENCE TO RELATED APPLICATIONS

This is a U.S. national-stage application filed pursuant to 35 U.S.C. §371 and claims benefit of International Application No. PCT/US2011/029064, which was filed on Mar. 18, 2011, and is incorporated herein by reference in its entirety.

BACKGROUND

The following description is provided to assist the understanding of the reader. None of the information provided or references cited is admitted to be prior art.

Electronic waste can contain large amounts of valuable materials. For example, used computer chips can contain gold, silver, other metals, and other purified materials. As raw materials become more expensive, recycling used materials become economically feasible. For instance, there are multiple industries built around recycling steel, aluminum, paper, copper, and glass.

Electronic waste can also represent an environmental challenge. Increasingly, electronic waste ends up in landfills where the materials of the electronic waste can enter groundwater where the materials could constitute a public health hazard.

The economics of recycling can be in large part based upon the ability to successfully and effectively separate input waste. Further, the purity of the separated waste components can determine whether it is possible and cost effective to process the waste components into new products. There are many tools that can be used to separate materials for recycling. Some recycling tools take advantage of differences of either the chemical or physical properties of the components in electronic waste. For example, some of these physical and chemical properties include solubility in a polar or non-polar solvent, density, electrowinning, magnetic properties, electrical conductivity, and triboelectric effect.

SUMMARY

Illustrative methods of and apparatus for separating material include irradiating a mixture of a first material, such as a semiconductor material, and a difference in conductance between the first material and the second material. In some example, irradiation causes the conductance of the first material to be greater than that of the second material. Applying an electric field to the irradiated mixture with a pair of electrodes causes at least some of the first material to separate from the second material due to the difference in conductance.

In some cases, the first material is a semiconductor material, such as germanium, silicon germanium, copper indium diselenide, silicon, copper indium gallium diselenide, indium phosphide, gallium arsenide, cadmium telluride, copper gallium diselenide, and hydrogenated amorphous silicon. The second material may also be a semiconductor material (different than the first material). The first and second materials are ground or crushed into particles whose average size ranges from about 100 μm to about 8 mm. Average particle volumes may range from about. 0.5 nl to about 0.3 ml.

The source used to irradiate the mixture may include an infrared light source and/or a near-infrared light source that emits light at a wavelength within a range of about 730 nm to about 1860 nm. The source can be narrowband source (e.g., a laser) or a filtered broadband source (e.g., an arc lamp with a notch or bandpass filter). In some embodiments, the wavelength corresponds to an energy that is (a) greater than a band gap energy of the first material and (b) less than a band gap energy of the second material.

The electrodes, one of which can be a ground electrode, can be operably coupled to a power supply that generates a potential difference between the electrodes within a range of about 10 V to about 30 kV. In some cases, the ground electrode includes a roll cylinder configured to move the material into the electric field. Additional examples includes an ammeter that measures current flow from the ground electrode to ground. A controller operably coupled to the ammeter determines the portion of the first material excited by the electric field based on the current and adjusts the power supply and the roll cylinder speed accordingly.

Further examples may include a vibratory feeder that feeds the mixture onto a conveyor, which moves the mixture past the source and/or a container configured to receive the separated material.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
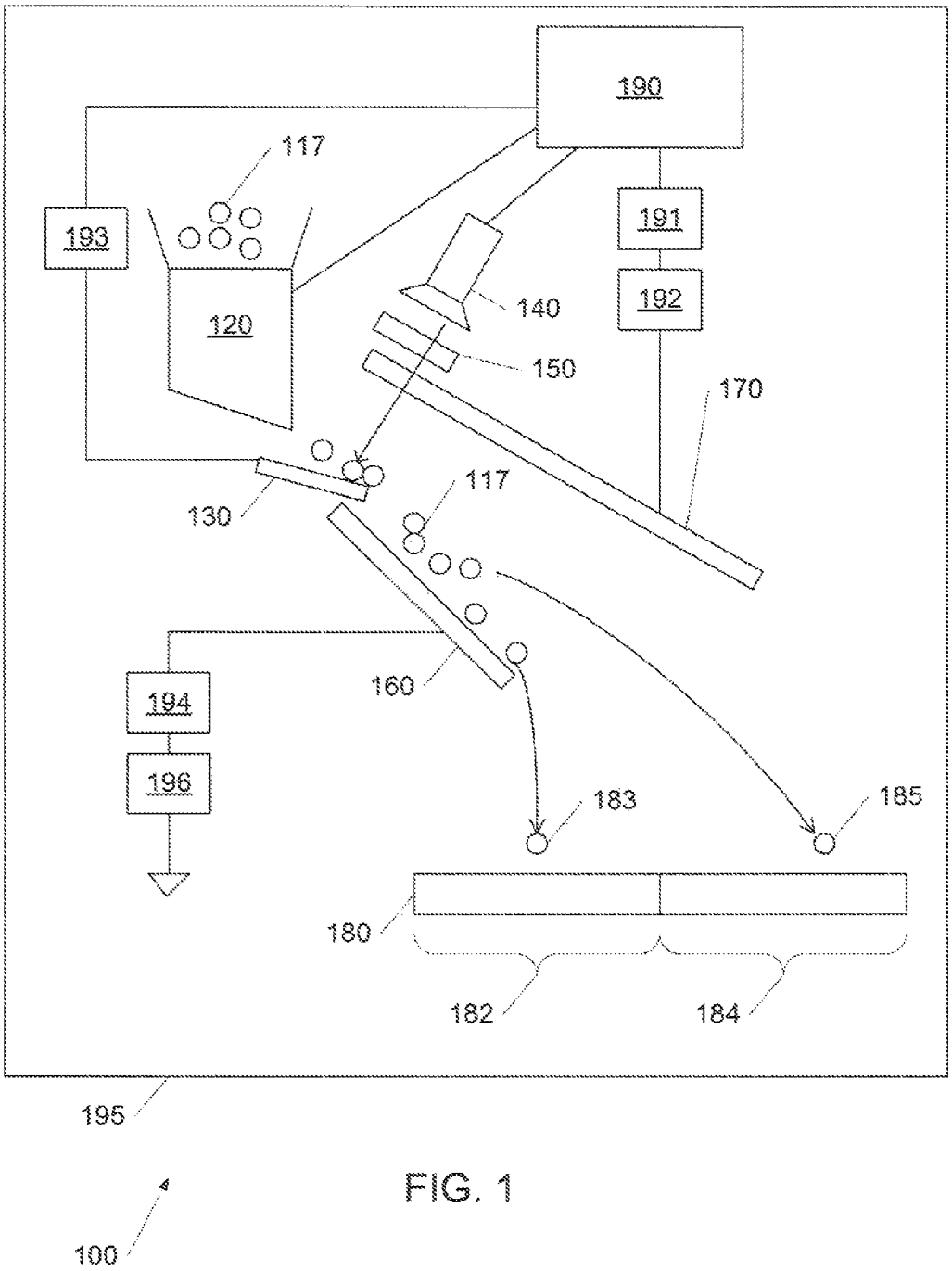
FIG. 1 is a schematic of an electrostatic material separation device in accordance with an illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Described herein are illustrative systems, methods, computer-readable media, etc. for radiation assisted electrostatic separation of semiconductor materials. Radiation assisted electrostatic separation (RAES) can be used to separate a powdered mixture of different semiconductor materials or a mixture of semiconductor and non-semiconductor materials. Exposure to radiation of higher energy than the semiconductor's band gap causes the resistivity of the particles to decrease. In some examples, the resistivity can decrease several orders of magnitude. For example, to separate semiconductor particles of different band gap energies, the radiation energy can be set above the band gap of one semiconductor material, but below the energy of another semiconductor material. An electrostatic separator optimized to sort materials of different conductivities can be used to separate the mixture. Advantageously, radiation assisted electrostatic separation can be dry, inexpensive, easily implemented, and effective at separating materials of different band gap energies. Advantageously, radiation assisted electrostatic material separation can be used to separate semiconductor materials without wet processing of materials or high temperatures.

Insulators and semiconductor materials have a band gap, which refers to the energy difference between the top of the valence band and the bottom of the conduction band of the material. The band gap determines the wavelength where radiation is absorbed by a semiconductor material. At wavelengths of higher energy (i.e., shorter wavelengths) than the band gap, absorption occurs and electrons are excited from the valence band to the conduction band. In this process, the conductivity of the material increases, a phenomenon known as photoconductivity. The conductivity of a material can change four orders of magnitude when exposed to high intensity radiation above the band gap energy. However, below the band gap energy, there is no change in conductivity. By setting the wavelength delivered by a light source, the conductivity of different types of semiconductor materials can be modified.

Referring to FIG. 1, a schematic of an electrostatic material separation device 100 in accordance with an illustrative embodiment is shown. The electrostatic material separation device 100 can include a vibratory feeder 120, a conveyor 130, a light source 140, a filter 150, a first electrode 160, a second electrode 170, a bin 180, a controller 190, and an enclosure 195. The controller 190 can control the vibratory feeder 120, the conveyor 130, the light source 140, the first electrode 160, the second electrode 170, and the enclosure 195 to electrostatically separate material.

The vibratory feeder 120 can be loaded with a mixture 117, which may include powdered material(s) and/or particulate material(s). The mixture 117 can be obtained in many possible ways. In one illustrative embodiment, the mixture 117 can be separated from ground waste semiconductor packages using electrostatic separators, triboelectric separators, or density separators. In another illustrative embodiment, the mixture 117 can be thin film photovoltaic material scraped or brushed from a substrate. In another illustrative embodiment, the mixture 117 can be brushed or scraped off of semiconductor process equipment during cleaning (e.g., MOCVD, MBE, CVD, and evaporation equipment). In another illustrative embodiment, the mixture 117 can be ground up reject wafers, reject die, dicing edge waste, and/or dicing saw dust. In another illustrative embodiment, the mixture 117 can be precipitate from an etching or processing solution (e.g., KOH etch).

In an illustrative embodiment, the mixture 117 can include a first material and a second material. The mixture 117 can include ground, chopped, pulverized and/or broken pieces of, for example, but not limited to, circuit boards, wafers, and packaged integrated circuits. The mixture 117 can include pieces (i.e., particles) with an average volume that that ranges from about 0.5 nl to about 0.3 ml; in some embodiments the average particle volume is about 1.0 nl, 2.0 nl, 5.0 nl, 10 nl or any other volume between 0.5 nl to 0.3 ml. The average particle diameter (or largest dimension) can range from about 100 μm to about 8 mm, e.g., 100 μm, 200 μm, 300 μm, 400 μm, 500 μm, 750 μm, 1.0 mm, 2.0 mm, or any other diameter between about 100 μm and about 8.0 mm. Optimal separation may occur when the particles are of similar (though not necessarily uniform) size. In addition, the separator 100 operating parameters, such as electrode voltage and conveyor speed, may be optimized for the average particle size and/or range of particle sizes in the mixture 117. For example, separating a mixture 117 of smaller particles may require lower voltages and a steeper drop on the electrode.

In one embodiment, the first material includes a semiconductor material and the second material can be, for example, but not limited to, an insulator-type material such as glass, glass reinforced thermoplastic (i.e., Duroid™), thermoplastic, glass reinforced epoxy (e.g., FR4), thermoplastic, potting, and passivation. In other embodiments, the first and second materials include different semiconductor materials. The first semiconductor material and the second semiconductor material can be, for example, but not limited to, at least one of germanium, silicon germanium, copper indium diselenide, silicon, copper indium gallium diselenide, indium phosphide, gallium arsenide; cadmium telluride, copper gallium diselenide, and hydrogenated amorphous silicon.

The vibratory feeder 120, which can be, for example, but not limited to a bin or plate vibrated by a Kendrion SR1010004 oscillating solenoid available from Kendrion N.V., Netherlands, can meter and distribute the mixture 117 onto the conveyor 130. In an illustrative embodiment, the conveyor 130 can be made of a conductor such as, but not limited to, stainless steel or aluminum plate (also vibrated by a Kendrion SR1010004 oscillating solenoid available from Kendrion N.V., Netherlands). The conveyor 130 can be maintained at a high voltage, for example, but not limited to, about 10 V to about 30 kV. Specific examples of voltages include about 10 V, about 100 V, about 1 kV, about 5 kV, about 10 kV, about 20 kV, about 30 kV, and ranges between any two of these values. The controller 190 can control the voltage of the conveyor 130. As the mixture 117 travels down the conveyor 130, the particles of the mixture 117 can pick up charge through contact with the conveyor 130. In another illustrative embodiment, the conveyor 130 can be made of a dielectric material such as, but not limited to, plastic or glass. As the mixture 117 travels down the conveyor 130, the particles of the mixture 117 can pick up charge through the triboelectric effect.

As the mixture 117 travels down the conveyor 130, the particles of the mixture 117 can be exposed to radiation from light source 140. In an illustrative embodiment, the light source 140 can be a narrowband light source, such as a laser or a filtered source. The light source 140 can have a peak output wavelength of, for example, but not limited to, at least one of 730 nm, 752 nm, 862 nm, 868 nm, 919 nm, 1108 nm, 1217 nm, and 1853 nm. The light source 140 can have an output wavelength range of, for example, but not limited to, about 730 nm to about 1860 nm. The wavelength of the light source 140 can be selected such that the energy of the wavelength of the light source 140 is greater than a band gap energy of the first semiconductor material of the mixture 117 and less than a band gap energy of the second material of the mixture 117. The light source 140 can be, for example, but is not limited to, a mercury lamp, a tungsten lamp, an ultraviolet lamp, an infrared lamp, a near-infrared lamp, a light emitting diode, or a laser. The light source 140 can be, for example, a Newport Corp. 66924 arc lamp source available from Newport Corp., Irvine, Calif. which is a 1000 W broadband light source (200-2500 nm) with a filter holder.

In another illustrative embodiment, the light source 140 can include a filter 150. The filter 150 can be a cutoff filter, a bandpass filter, or a series of cutoff filters. The filter 150 can have a peak pass-through wavelength of, for example, but not limited to, at least one of 730 nm, 752 nm, 862 nm, 868 nm, 919 nm, 1108 nm, 1217 nm, and 1853 nm. The filter 150 can have a pass-through wavelength range of, for example, but not limited to, about 730 nm to about 1860 nm. The filter 150 can be, for example, a filter from the Newport Corp. FS-SWF-B filter set available from Newport Corp., Irvine, Calif., which is a set of ten short-pass filters with various cutoffs up to 1000 nm. The wavelength of the filter 150 can be selected such that the energy of the pass-through wavelength of the filter 150 is greater than a band gap energy of the first semiconductor material of the mixture 117 and less than a band gap energy of the second material of the mixture 117. Using a filter can allow for tighter transmittance profiles and/or a wider variety of light sources.

As discussed above, the energy of the wavelength of the light source 140 or the filter 150 can be selected such that the energy of the wavelength of the light source 140 is greater than a band gap energy of the first material of the mixture 117 and less than a band gap energy of the second material of the mixture 117. The following list provides examples of semiconductors and their band gaps (eV) and a corresponding wavelength (nm): germanium, Ge, 0.67 eV, 1853 nm; silicon germanium, Si:Ge 0.67-1.12 eV, 1108-1853 nm; copper indium diselenide, CuInSe2 (CIS), 1.02 eV, 1217 nm; silicon, Si (crystalline), 1.12 eV, 1108 nm; copper indium gallium diselenide, Cu(In,Ga)Sc2, 1.04-1.67 eV, 743-1193 nm; indium phosphide, InP, 1.35 eV, 919 nm; gallium arsenide, GaAs, 1.43 eV, 868 nm; cadmium telluride, CdTe, 1.44 eV, 862 nm; copper gallium diselenide, CuGaSc2, 1.65 eV, 752 nm; and hydrogenated amorphous silicon, Si:H (amorphous), 1.7 eV, 730 nm.

In contrast, the band gap of most insulators is, relatively, very large; for example, diamond, an insulator, has a band gap of about 6 eV. Thus, if the first material is a semiconductor and the second material is an insulator, irradiating the mixture 117 with a wavelength corresponding to an energy greater than a band gap energy of the first material and less than a band gap energy of the second material increases the conductivity of the first material but not the conductivity of the second material. Suppose thermoplastic packaging has a band gap of 5 eV (250 nm, which is in the deep/far UV range). Then, for example, in a mixture including silicon (Si (crystalline), 1.12 eV, 1108 nm which is in the infrared range) and thermoplastic packaging (5 eV, 250 nm), the energy of the selected wavelength of the light source 140 or filter 150 can be selected to be greater than 1.12 eV but less than 5 eV. Consequently, the wavelength of the light source 140 or filter 150 can be selected to be shorter than 1108 nm but longer than 250 nm. The conductivity of the silicon (normally about $1.2\times10^{-5}$ S $cm^{-1}$ at STP) can change about four orders of magnitude when exposed to high intensity radiation above the band gap energy. The conductivity of the thermoplastic packaging is typically negligible.

In another example, the energy of the wavelength of the light source 140 or filter 150 can be selected such that the energy of the wavelength of the light source 140 is greater than a band gap energy of a first semiconductor material of the mixture 117 and less than a band gap energy of a second semiconductor of the mixture 117. Then, for example, in a mixture including silicon (Si (crystalline), 1.12 eV, 1108 nm) and amorphous silicon (Si:H (amorphous), 1.7 eV, 730 nm), the energy of the selected wavelength of the light source 140 or filter 150 can be selected greater than 1.12 eV but less than 1.7 eV. Consequently, the wavelength of the light source 140 or filter 150 can be selected to be shorter than 1108 nm but longer than 730 nm. The conductivity of the silicon (normally about $1.2\times10^{-5}$ S $cm^{-1}$ at standard temperature and pressure (STP)) can change about four orders of magnitude when exposed to high intensity radiation above the band gap energy. The conductivity of the amorphous silicon remains about the same at, e.g., about $3\times10^{-5}$ S $cm^{-1}$ at STP.

As the mixture 117 is exposed to radiation from light source 140, at least one type of the particles of the mixture 117 become more conductive and at least one type of the particles of the mixture 117 maintain their conductivity. In an illustrative embodiment, where the mixture 117 includes the first and second materials, the first material becomes more conductive whereas the second material substantially or fully maintains its conductivity. In another illustrative embodiment, where the mixture 117 includes first semiconductor material and second semiconductor material, the first semiconductor material becomes more conductive whereas the second semiconductor material substantially or fully maintains its conductivity.

The conveyor 130 can transfer the mixture 117 to the first electrode 160. The first electrode 160 can be configured as a discharge apparatus. The first electrode 160 can be positioned on an incline such that the mixture 117 traverses the length of the first electrode 160. In an illustrative embodiment, the first electrode 160 can be grounded. When the mixture 117 comes in contact with the first electrode 160, the particles of the mixture 117 that are more conductive will discharge faster than the particles that are less conductive. For example, if the first material is more conductive than the second material after exposure to the light source 140, the first material will discharge faster than the second material. Thus, placing the mixture 117 on the first electrode 160 causes the second material to be charged relative to the discharged first material. Where the mixture 117 includes the first and second semiconductor material, and the first semiconductor material is more conductive than the second semiconductor material after exposure to the light source 140, the first semiconductor material discharges faster than the second semiconductor material. Thus, the second semiconductor material is charged relative to the first semiconductor material which has been substantially or fully discharged. The first electrode 160 can be stationary or moving (e.g., on a vibrating or rotating drum, roll cylinder, or belt). In some cases, the first electrode 160 may form part of or include a vibrating drum, rolling drum, roll cylinder, belt, or other component suitable for moving the mixture 117.

The second electrode 170 can be positioned across from the first electrode 160 such that the first electrode 160 and the second electrode 170 form a channel. The second electrode 170 can include a mesh section configured to allow light from the light source 140 to pass through. The second electrode 170 can be any shape, for example, but not limited to, an ellipse, a curved sheet, or a plane. The second electrode 170 can be held at a positive potential of 10 V to 30 kV relative to the first electrode 160. Thus, an electric field can be generated between the first electrode 160 and the second electrode 170. As the mixture 117 traverses the length of the first electrode 160, the charged particles of the mixture 117 are attracted to the first electrode 160, which is at ground or slightly positive or negative. The discharged particles of the mixture 117 are attracted to the second electrode 170, which is at which is at a relatively high, positive potential relative to the first electrode 160. For example, the first material of the mixture 117 has no or minimal charge and can be drawn towards the second electrode 170 which is at a relatively high, positive potential. The second material of the mixture 117 stay by the first electrode 160 and are not be drawn to the second electrode 170. As gravity acts on the mixture 117, the first and second materials follow different trajectories due to the difference in electromotive force exerted by electrodes 160 and 170. The second material of the mixture 117 generally follows a first trajectory 183 into a first section 182 of the bin 180. The first material of the mixture 117 can generally follow a second trajectory 185 into a second section 184 of the bin 180. Advantageously, the first and second materials of the mixture 117 can be physically separated without chemicals, high temperatures, or without getting the mixture 117 wet. In other embodiments, the first material and the second material can be separated by selecting a light source 140 and/or filter 150 such that the energy of the wavelength of the light source 140 and/or filter 150 is greater than a band gap energy of the first material of the mixture 117 and less than a band gap energy of the second semiconductor of the mixture 117.

The vibratory feeder 120, the conveyor 130, the light source 140, the filter 150, the first electrode 160, the second electrode 170, and the bin 180 optionally can be contained in an enclosure 195. The enclosure 195 can be configured to regulate the atmosphere in which the light source 140 irradiates the mixture 117. In one illustrative embodiment, the enclosure 195 can be filled with dry nitrogen gas. In other illustrative embodiments, the enclosure 195 can be under vacuum or be filled with an inert gas such as argon. Advantageously, enclosure 195 can prevent ionized particles from interfering with the separation operations, protect operators, and lower the operating voltages of electrode plates.

As discussed above, the controller 190 can control the vibratory feeder 120, the conveyor 130, the light source 140, the first electrode 160, the second electrode 170, and the enclosure 195. The controller 190 can adjust the speed of the vibratory feeder 120 in order to meter the amount of the mixture 117 on the conveyor 130 and the first electrode 160. The controller 190 can also adjust the voltages of the conveyor 130, the first electrode 160, and the second electrode 170. The controller 190 can adjust the voltage of the conveyor 130 by controlling a first power supply 193. The controller 190 can adjust the voltage of the second electrode 170 by controlling a second power supply 191. The first power supply 193 and the second power supply 191 can be, for example, an EQ Series Bench Top High Voltage Power Supply available from Matsusada Precision, Inc., Kusatsu-City, Shiga, Japan, which is a 0-30 V, 30 W power supply. In an alternative embodiment, the controller 190 can adjust the voltage of the first electrode 160 by controlling a third power supply 196. In another illustrative embodiment, where the first electrode 160 is a roll cylinder, the controller 190 can control the speed of the roll cylinder to match the metering of the vibratory feeder 120. The controller 190 can monitor and control the gas flow and pressure within the enclosure 195.

In one illustrative embodiment, the conveyor 130 and the second electrode 170 can be held at a potential of 1000 V and the first electrode 160 can be grounded. The controller 190 can measure the current between the second electrode 170 and the second power supply 191 using a first ammeter 192; and the current between the first electrode 160 and ground using a second ammeter 194. The current flowing between the second electrode 170 and the second power supply 191 will be proportional to the number of particles of the mixture 117 striking the second electrode 170. The current flowing from the first electrode 160 to ground will be proportional to the number of particles of the mixture 117 dissipating their charge. Particles of the mixture 117 that strike the second electrode 170 will return to the first electrode 160. Hence, the controller 190 can adjust the voltage of the conveyor 130 and the second electrode 170 in order to optimize the efficiency of the electrostatic material separation device 100. For example, the controller 190 can reduce the voltage of the conveyor 130 and the second electrode 170 when the measured current is above a threshold.

As understood by those of skill in the art, the potential difference between the first electrode 160 and the second electrode 170 and/or the angle of the first electrode 160 can be changed, e.g., in response to commands from the controller 190, to accommodate the average size of the particles in the mixture 117. For smaller particles, the charge to mass ratio may be high enough that the particles sticks to the second electrode 170. If the particles stick to the second electrode 170, the first electrode 160 can be tilted, causing the particles to fall faster, and the voltage lowered until the particles no longer stick to the second electrode 170. Larger particles may be separated more easily using higher voltages and/or shallower angles. With proper engineering, the separator 100 should be able to separate mixtures that include particles whose sizes span a wide range.

Figure 2:
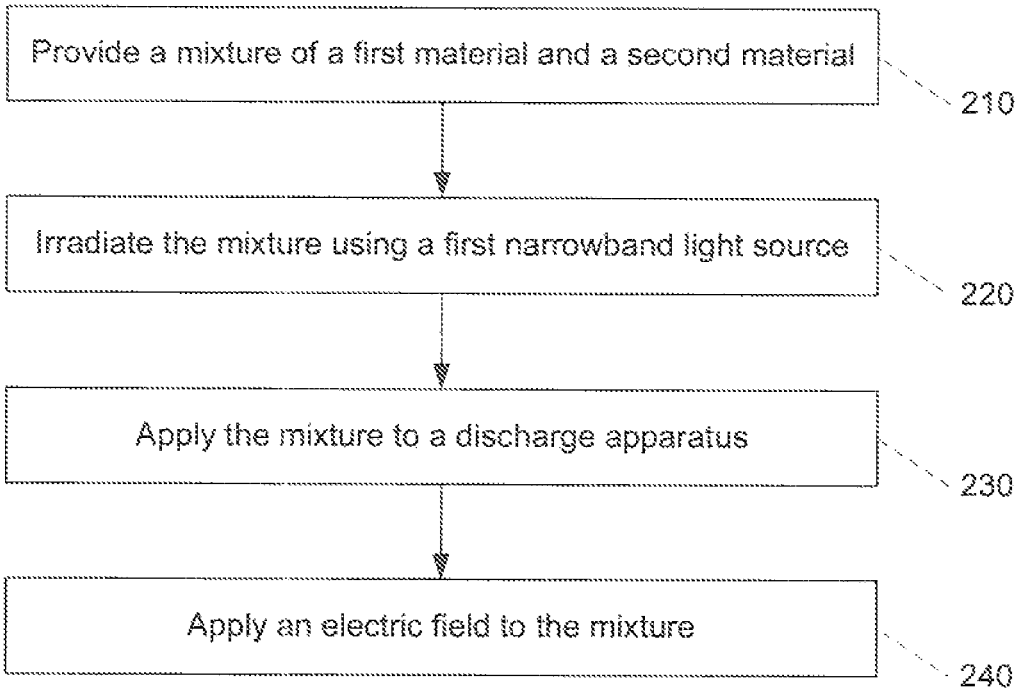
FIG. 2 is a flow diagram illustrating electrostatic material separation operations performed in accordance with an illustrative embodiment.

FIG. 2 is a flow diagram illustrating operations performed to separate material electrostatically in accordance with an illustrative embodiment. In alternative embodiments, fewer, additional, and/or different operations may be performed. In an operation 210, a mixture of a first material and a second material can be provided. The mixture can include ground, chopped, pulverized and/or broken pieces of, for example, but not limited to, circuit boards, wafers, and packaged integrated circuits. The mixture can include pieces (i.e., particles) whose average volume is within a range of about 0.5 nl to about 0.3 ml, and/or whose average largest dimension is within a range of about 100 μm to about 8.0 mm. The first material can be a semiconductor and the second material can be, for example, but not limited to, an insulator-type material such as glass reinforced thermoplastic (i.e., Duroid™), thermoplastic, glass reinforced epoxy (e.g., FR4), thermoplastic, potting, and passivation. In other cases, the first and second materials can include different semiconductor materials. The first semiconductor material and the second semiconductor material can be, for example, but not limited to, at least one of germanium, silicon germanium, copper indium diselenide, silicon, copper indium gallium diselenide, indium phosphide, gallium arsenide, cadmium telluride, copper gallium diselenide, and hydrogenated amorphous silicon.

The mixture can be provided to, for example, but not limited to, a conveyor. In an illustrative embodiment, the conveyor can be made of a conductor such as, but not limited to, stainless steel or aluminum. The conveyor can be maintained at a high voltage, for example, but not limited to, 10 V to 30 kV. Specific examples of voltages include about 10 V, about 100 V, about 1 kV, about 5 kV, about 10 kV, about 20 kV, about 30 kV, and ranges between any two of these values. As the mixture travels down the conveyor, the particles of the mixture can pick up charge through contact with the conveyor. In another illustrative embodiment, the conveyor can be made of a dielectric material such as, but not limited to, plastic or glass. As the mixture travels down the conveyor, the particles of the mixture can pick up charge through triboelectric effect.

In an operation 220, the mixture can be irradiated using a narrowband light source. The light source can have a peak output wavelength of, for example, but not limited to, at least one of 730 nm, 752 nm, 862 nm, 868 nm, 919 nm, 1108 nm, 1217 nm, and 1853 nm. The light source can have an output wavelength range of, for example, but not limited to about 730 nm to about 1860 nm. The wavelength of the light source can be selected such that the energy of the wavelength of the light source is greater than a band gap energy of the first material of the mixture and less than a band gap energy of the second material of the mixture. The light source can be, for example, but not limited to, a mercury lamp, a tungsten lamp, an ultraviolet lamp, an infrared lamp, a near-infrared lamp, a light emitting diode, or a laser. In another illustrative embodiment, the light source can include a filter. The filter can be a cutoff filter, a bandpass filter, or a series of cutoff filters.

As the mixture is exposed to radiation from the source, at least one type of the particles of the mixture become more conductive and at least one type of the particles of the mixture substantially or fully maintains its conductivity. In an illustrative embodiment, where the mixture includes the first and second materials, the first material becomes more conductive whereas the second material substantially or fully maintains its conductivity. In another illustrative embodiment, where the mixture includes the first semiconductor material and second semiconductor material, the first semiconductor material becomes more conductive whereas the second semiconductor material substantially or fully maintains its conductivity.

In an operation 230, the mixture can be applied to a discharge apparatus. The discharge apparatus can be, for example, but not limited to, a first electrode. When the mixture comes in contact with the discharge apparatus, the particles of the mixture that are more conductive will discharge faster than the particles that are less conductive. For example, where the powdered mixture includes a semiconductor material and another material, the semiconductor material is more conductive and the other material substantially or fully maintains its conductivity after exposure to the radiation. As a result, the semiconductor material discharges faster than the other material. Thus, the other material is charged relative to the semiconductor material which has been substantially or fully discharged. Where the mixture includes the first and second semiconductor materials, the first semiconductor material is more conductive, and the second semiconductor material substantially or fully maintains its conductivity after exposure to the radiation, the first semiconductor material discharges faster than the second semiconductor material. Thus, the second semiconductor material is charged relative to the first semiconductor material which has been substantially or fully discharged. The discharge apparatus can be stationary or moving (i.e., vibrating or a rotating drum, roll cylinder, or belt).

In an operation 240, an electric field can be applied to the mixture. The electric field can, for example, be generated between the discharge apparatus and a second electrode. The electric field is adapted to substantially or fully separate the second material from the first semiconductor material. The second electrode can be held at a positive potential of about 10V to about 30 kV relative to the discharge apparatus. Specific examples of voltages include about 10 V, about 100 V, about 1 kV, about 5 kV, about 10 kV, about 20 kV, about 30 kV, and ranges between any two of these values. Thus, an electric field can be generated between the discharge apparatus and the second electrode. As the mixture traverses the discharge apparatus, the charged particles of the mixture are attracted to the discharge apparatus, which is at ground or slightly positive or negative. The discharged particles of the mixture are attracted to the second electrode, which is at which is at a relatively high, positive potential relative to the discharge apparatus. For example, the first material of the mixture has no or minimal charge and can be drawn towards the second electrode which is at a relatively high, positive potential. The second material of the mixture will stay by the discharge apparatus and will not be drawn to the second electrode. As gravity acts on the mixture, the second material of the mixture and the first semiconductor material of the mixture can be separated. The second material of the mixture can generally follow a first trajectory into a first section of a bin. The first material of the mixture can generally follow a second trajectory into a second section of the bin. Advantageously, the second material and the first material of the mixture can be physically separated without chemicals or without getting the mixture wet. In other embodiments, first and second semiconductor materials can be separated by selecting a narrowband light source and/or filter such that the energy of the wavelength of the narrowband light source and/or filter is greater than a band gap energy of the first semiconductor material of the mixture and less than a band gap energy of the second semiconductor of the mixture.

The following are non-limiting examples of radiation assisted electrostatic separation of material in accordance with illustrative embodiments:

EXAMPLE 1

Separation of Semiconductor Material from Scrapped Circuit Boards

After grinding up circuit boards, the semiconductor materials of the circuit boards can be separated from other materials of the circuit boards using a variety of different techniques. Although the bulk of the semiconductor material can be silicon, the semiconductor material can also include Si:Ge, GaAs, InP, and other III-V semiconductors used for high speed or optoelectronic circuits. First, using the electrostatic material separation device of FIG. 1 with a low pass optical filter with a cutoff of about 1130 nm (such as those commercially available from Thorlabs Co., Newton, N.J.), alloys of Si:Ge can be extracted from the ground up circuit boards. Second, the ground up circuit boards are then sent through the electrostatic material separation device of FIG. 1 with a low pass optical filter with a cutoff of about 1000 nm (commercially available from Thorlabs Co., Newton, N.J.) whereby silicon can be separated from the III-V compounds such as GaAs and InP. The electrostatic material separation device of FIG. 1 can be used to further process the ground up circuit boards using additional wavelengths.

EXAMPLE 2

Separation of Crystalline Silicon from a-Si:H

After grinding up, for example, solar panels, liquid crystal displays, and led emitting diode displays, high purity silicon can be separated from hydrogenated amorphous silicon (a-Si:H), which contains hydrogen and other impurities. Using the electrostatic material separation device of FIG. 1 with a low pass optical filter with a cutoff of between about 750 nm and 1088 nm (commercially available from Thorlabs-Co., Newton, N.J.), alloys of Si:Ge can be extracted from the ground up solar panels. The crystalline silicon can become a better conductor while the amorphous silicon would remain unchanged. Thus, the crystalline silicon can be electrostatically separated from the amorphous silicon as described above.

EXAMPLE 3

Separation of Si from III-V Semiconductors

Hybrid modules can contain Si and III-V semiconductors. For example, high speed electronic modules for CATV, communications, measurement systems, and defense applications can contain many different types of circuits mounted on a multichip substrate. The III-V devices can be a high speed part of the circuit or the optical communication circuits, while the logic and interface can be based on silicon. Ground up hybrid modules can be processed through the electrostatic material separation device of FIG. 1 with a low pass optical filter with a cutoff of about 1000 nm (commercially available from Thorlabs Co., Newton, N.J.), whereby silicon can be separated from the III-V compounds such as GaAs and InP.

EXAMPLE 4

Sorting CIGS by Gallium Concentration

In the semiconductor material CIGS (Cu(ln,Ga)Sc2), substitution of gallium for indium changes the band gap from 1.04 to 1.67 eV. Using a variety of filters on the electrostatic material separation device of FIG. 1 (between 743 and 1193 nm), the material can be binned by the ratio of indium to gallium.

EXAMPLE 5

Separation of Semiconductor Material from Glass or Ceramic

Ground up solar cells or electronic packages include a mixture of polymer, glass, ceramic, metal, and semiconductor material. Polymer material can be separated using triboelectric separation, and the metal can be separated from the remaining material using electrostatic separation. The semiconductors can be separated from the glass and ceramic using the electrostatic material separation device of FIG. 1, by making the semiconductor particles more conductive. Glass has a band gap of about 9 eV or 137 nm. Since particles at wavelengths of 137 nm and below are absorbed by air, use of a high-intensity visible light source (e.g., tungsten) without a filter would increase the conductivity of all semiconductor material relative to glass. Thus, the electrostatic material separation device of FIG. 1 with a tungsten light source can be used to separate glass from semiconductor material.

EXAMPLE 6

Recycling Si/(III-V) Heterostructures

III-V materials (GaAs, InGaAs, etc.) integrated onto silicon integrated circuits can be used to create optoelectronic devices, Quantum Well FETs (QWFET), and other devices. Ground up optoelectronic devices can be sent through the electrostatic material separation device of FIG. 1 with a low pass optical filter with a cutoff of about 1000 nm whereby silicon can be separated from the III-V compounds such as GaAs and InP.

A flow diagram is used herein. The use of flow diagrams is not meant to be limiting with respect to the order of operations performed. The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage or the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A method of separating material, the method comprising:

irradiating a mixture of a first material and a second material at a wavelength emitted by a light source, wherein the wavelength increases a conductivity of the first material and wherein the second material maintains its conductivity responsive to the wavelength; and applying an electric field to the mixture, the electric field causing at least some of the first material to separate from the second material due to a difference in conductance, wherein the wavelength corresponds to an energy that is (a) greater than a band gap energy of the first material, and (b) less than a band gap energy of the second material.

2. The method of claim 1, wherein the first material includes a semiconductor material.

3. The method of claim 2, wherein the first material comprises at least one of germanium, silicon germanium, copper indium diselenide, silicon, copper indium gallium diselenide, indium phosphide, gallium arsenide, cadmium telluride, copper gallium diselenide, and hydrogenated amorphous silicon.

4. The method of claim 2, wherein the second material comprises a second semiconductor material.

5. The method of claim 1, wherein the mixture comprises particles having an average particle volume within a range of between about 0.5 nl to about 0.3 ml.

6. The method of claim 1, wherein the mixture comprises particles having an average particle dimension within a range of between about 100 μm and about 8.0 mm.

7. The method of claim 1, wherein irradiating the mixture includes generating radiation with at least one of an infrared light source and a near-infrared light source.

8. The method of claim 1, wherein the wavelength is within a range of about 730 nm to about 1860 nm.

9. The method of claim 1, wherein the irradiating causes the conductance of the first material to be greater than the conductance of the second material.

10. The method of claim 1, wherein applying the electric field to the mixture comprises generating the electric field between two electrodes having a potential difference within a range of about 10 V to about 30 kV.

11. The method of claim 10, wherein one of the two electrodes comprises a ground electrode, and further comprising:

measuring a current from the ground electrode to ground; and determining a portion of the first material excited by the electric field based on the current.

* * * * *

UNITED STATES PATENT AND TRADEMARK OFFICE

CERTIFICATE OF CORRECTION

PATENT NO. : 9,289,781 B2
APPLICATION NO. : 13/144869
DATED : March 22, 2016
INVENTOR(S) : Yager It is certified that error appears in the above-identified patent and that said Letters Patent is hereby corrected as shown below:

Specification

In Column 1, Line 9, delete "§371" and insert -- § 371 --, therefor.

In Column 5, Line 31, delete "CuGaSc2," and insert -- CuGaSe2, --, therefor.

In Column 12, Line 31, delete "or the" and insert -- of the --, therefor.

Signed and Sealed this
Fourteenth Day of June, 2016

Michelle K. Lee

Michelle K. Lee
*Director of the United States Patent and Trademark Office*